US012546170B2

(12) United States Patent
Tu et al.

(10) Patent No.: US 12,546,170 B2
(45) Date of Patent: Feb. 10, 2026

(54) IMPACT-RESISTANT MULTI-CUTTING-EDGE DIAMOND COMPACT AND EARTH-BORING TOOL

(71) Applicants: KINGDREAM PUBLIC LIMITED COMPANY, Hubei (CN); SINOPEC OILFIELD EQUIPMENT CORPORATION, Hubei (CN)

(72) Inventors: Guanfu Tu, Hubei (CN); Xia Yang, Hubei (CN); Fang Xu, Hubei (CN)

(73) Assignees: KINGDREAM PUBLIC LIMITED COMPANY, Wuhan (CN); SINOPEC OILFIELD EQUIPMENT CORPORATION, Wuhan (CN)

( * ) Notice: Subject to any disclaimer, the term of this patent is extended or adjusted under 35 U.S.C. 154(b) by 0 days.

(21) Appl. No.: 18/843,322

(22) PCT Filed: Mar. 3, 2023

(86) PCT No.: PCT/CN2023/079610
§ 371 (c)(1),
(2) Date: Sep. 3, 2024

(87) PCT Pub. No.: WO2023/165609
PCT Pub. Date: Sep. 7, 2023

(65) Prior Publication Data

US 2025/0172044 A1 May 29, 2025

(30) Foreign Application Priority Data

Mar. 3, 2022 (CN) ..... 202210201147.1

(51) Int. Cl.
*E21B 10/56* (2006.01)

(52) U.S. Cl.
CPC ..... *E21B 10/56* (2013.01)

(58) Field of Classification Search
CPC ..... E21B 10/56; E21B 10/52
See application file for complete search history.

(56) References Cited

U.S. PATENT DOCUMENTS 11,391,095 B2 * 7/2022 Tian ..... E21B 10/5676
11,873,684 B2 * 1/2024 Zhao ..... E21B 10/5673

FOREIGN PATENT DOCUMENTS

CN 209293690 U 8/2019
CN 110206490 A * 9/2019 ..... E21B 10/46
(Continued)

OTHER PUBLICATIONS

International Search Report of PCT Patent Application No. PCT/CN2023/079610 issued on May 11, 2023.

*Primary Examiner* — Aaron L Lembo

(57) ABSTRACT

The present disclosure provides an impact-resistant multi-cutting-edge diamond compact, comprising a cylindrical cemented carbide substrate (102) and a diamond composite layer (101) being disposed at a top end of the cemented carbide substrate, wherein at least two sections of different chamfers (103, 104) are provided on a circumferential edge of a top end of the diamond composite layer (101), forming different cutting edges, the different cutting edges comprise at least one section of main cutting edge (103) and a section of impact-resistant cutting edge (104; 106) provided on each of two sides of the main cutting edge (103), a cutting performance of the main cutting edge (103) is better than that of the impact-resistant cutting edge (104; 106). According to the present disclosure, the compact has good cutting performance and side impact resistance on a gravel stratum, thereby prolonging the service life of the compact.

13 Claims, 6 Drawing Sheets

(56) References Cited

FOREIGN PATENT DOCUMENTS

| | | |
|---|---|---|
| CN | 213330910 U | 6/2021 |
| CN | 213980659 U | 8/2021 |

* cited by examiner

IMPACT-RESISTANT MULTI-CUTTING-EDGE DIAMOND COMPACT AND EARTH-BORING TOOL

CROSS-REFERENCE TO RELATED APPLICATIONS

The present disclosure claims the priority of Chinese patent application 202210201147.1, entitled "Impact-Resistant Multi-Cutting-Edge Diamond Compact" and filed on Mar. 3, 2022, the entirety of which is incorporated herein by reference.

FIELD OF THE INVENTION

The present disclosure relates to an impact-resistant multi-cutting-edge diamond compact, which is used as a cutting element of a diamond bit, and belongs to the technical field of petroleum drilling tool.

BACKGROUND OF THE INVENTION

Since the 1980s, diamond bits have been widely used in petroleum and natural gas drilling engineering. A diamond bit is mainly composed of a bit body and a cutting element. The diamond bits are divided into three categories according to the cutting element: PDC (polycrystalline diamond compact) bits, TSP (thermally stable polycrystalline diamond) bits, and natural diamond bits. The PDC bits are mainly used for drilling a soft to medium hard stratum, and after continuous technical progress, the PDC bits have an increasingly wide application range and have good economic value. The TSP bits are mainly used for drilling a medium-hard to extra-hard stratum. At present, deep well operations gradually increase in petroleum and natural gas drilling engineering, and strata encountered during drilling are also increasingly complicated.

The diamond compact is composed of a cylindrical cemented carbide substrate and a diamond composite layer, an edge of an end face of the diamond composite layer is chamfered to form a cutting edge of the compact. In the drilling process of the diamond bit, strata encountered during drilling in different areas are different, and required aggressiveness and impact resistances of the compact are different. In the drilling process of some gravel strata, a normal cutting face of the diamond compact often abrades normally while a side face undergoes relatively serious tooth breakage and failure, which further leads to the overall failure of the drill bit compact. It can be seen from these phenomena that the impact resistance required by the cutting face and the impact resistance required by the side face of the diamond compact are different, and a chamfer of the cutting edge of the existing compact is a single circumferential chamfer structure, which is difficult to meet drilling requirements of complicated strata.

SUMMARY OF THE INVENTION

In order to solve the above technical problem, the present disclosure provides an impact-resistant multi-cutting-edge diamond compact, which includes a cylindrical cemented carbide substrate and a diamond composite layer, the diamond composite layer being disposed at a top end of the cemented carbide substrate. At least two sections of different chamfers are provided on a circumferential edge of a top end of the diamond composite layer, so as to form different cutting edges, the different cutting edges include at least one section of main cutting edge and a section of impact-resistant cutting edge is provided on each of two sides of the main cutting edge, a cutting performance of the main cutting edge is better than that of the impact-resistant cutting edge, and a recessed flow guide cavity is provided on a top end face of the diamond composite layer to guide a water flow to the main cutting edge when a stratum is drilled so as to cool the main cutting edge.

In some embodiments of the present disclosure, the recessed flow guide cavity includes a flow guide groove that tapers from inside to outside along a radial direction of the diamond composite layer, and an outer end of the flow guide groove is adjacent to the main cutting edge or intersects with the main cutting edge.

In some embodiments of the present disclosure, the impact-resistant multi-cutting-edge diamond compact includes multiple sections of main cutting edges and multiple sections of impact-resistant cutting edges, the main cutting edges and the impact-resistant cutting edges being alternately provided, and a plurality of flow guide grooves are respectively and correspondingly provided between the multiple sections of main cutting edges and a center of the top end face of the diamond composite layer, inner ends of the plurality of flow guide grooves converging at the center of the top end face of the diamond composite layer.

In some embodiments of the present disclosure, the impact-resistant multi-cutting-edge diamond compact includes two recessed flow guide cavities provided at intervals.

In some embodiments of the present disclosure, the impact-resistant multi-cutting-edge diamond compact includes two main cutting edges provided at intervals, and the two recessed flow guide cavities provided at intervals extend between the two main cutting edges provided at intervals.

In some embodiments of the present disclosure, only one section of main cutting edge and one section of impact-resistant cutting edge are provided on the circumferential edge of the top end of the diamond composite layer.

In some embodiments of the present disclosure, the entire circumferential edge of the top end of the diamond composite layer is provided with 2 to 4 sections of different chamfers, thereby forming 2 to 4 sections of different cutting edges.

In some embodiments of the present disclosure, the chamfers include at least the following types: a single-beveled-surface chamfer, a double-beveled-surface chamfer, or a curved-surface chamfer.

In some embodiments of the present disclosure, two different sections of chamfers meet one of the following conditions:

types are different; and the types are the same, but structural parameters are different.

In some embodiments of the present disclosure, an included angle between a beveled surface of the chamfer and a radial plane of the diamond composite layer ranges from 20° to 70°, and the top end of the diamond composite layer is perpendicular to an axis of the cylindrical cemented carbide substrate.

In some embodiments of the present disclosure, an axial height of the chamfer ranges from 0.2 to 3 mm, or a radial width of the chamfer ranges from 0.2 to 5 mm.

In some embodiments of the present disclosure, the main cutting edge is a single-beveled-surface chamfer with a radial width of less than 0.4 mm and an included angle of 45°, or a single-beveled-surface chamfer with a radial width of greater than 0.4 mm and an included angle of less than 30°, or a double-beveled-surface chamfer with a radial width of greater than 0.4 mm and an inclination angle of less than 30° of an inner beveled-surface, and a central angle corresponding to each main cutting edge ranges from 50° to 70°.

In some embodiments of the present disclosure, the double-beveled-surface chamfer includes an inner beveled-surface and an outer beveled-surface, and an included angle between the outer beveled-surface and a radial plane of the diamond composite layer is greater than an included angle between the inner beveled-surface and the radial plane of the diamond composite layer.

In some embodiments of the present disclosure, the impact-resistant cutting edge is a single-beveled-surface chamfer with a radial width ranging from 0.5 to 2 mm and an included angle of greater than or equal to 45° or a circular arc chamfer with a radius of curvature ranging from 0.5 and 2 mm.

The present disclosure also provides an earth-boring tool, which includes an impact-resistant multi-cutting-edge diamond compact.

The present disclosure provides at least one of the following beneficial technical effects:

By providing different chamfers on the edge of the end face of the diamond composite layer to form multiple cutting edges in the circumferential direction of the end face of the diamond compact, different edges of the same compact are different in the aggressiveness and the impact resistance, i.e., the main cutting edge having relatively high cutting efficiency, two sides of the main cutting edge having relatively strong lateral impact resistance, so that the compact has relatively good cutting performance and side impact resistance in a gravel stratum, which prolongs the service life of the compact.

Since the edge of the end face of the diamond composite layer is chamfered to form cutting edges with different kinds of performance of the compact, the same diamond compact can meet drilling requirements of different strata, and by reasonably providing the diamond compact on the diamond bit, the diamond bit can adapt to the drilling requirements of complicated strata.

A flow guide cavity is formed in the end face of the diamond composite layer, which helps to guide a water flow to the main cutting edge to cool the main cutting edge when the compact performs cutting. In addition, the flow guide cavity is recessed, so that the heat dissipation area is increased, which further increases the drilling rate and prolongs the service life of the compact.

DETAILED DESCRIPTION OF THE EMBODIMENTS

The present disclosure will be further illustrated below in conjunction with embodiments.

Figure 1:
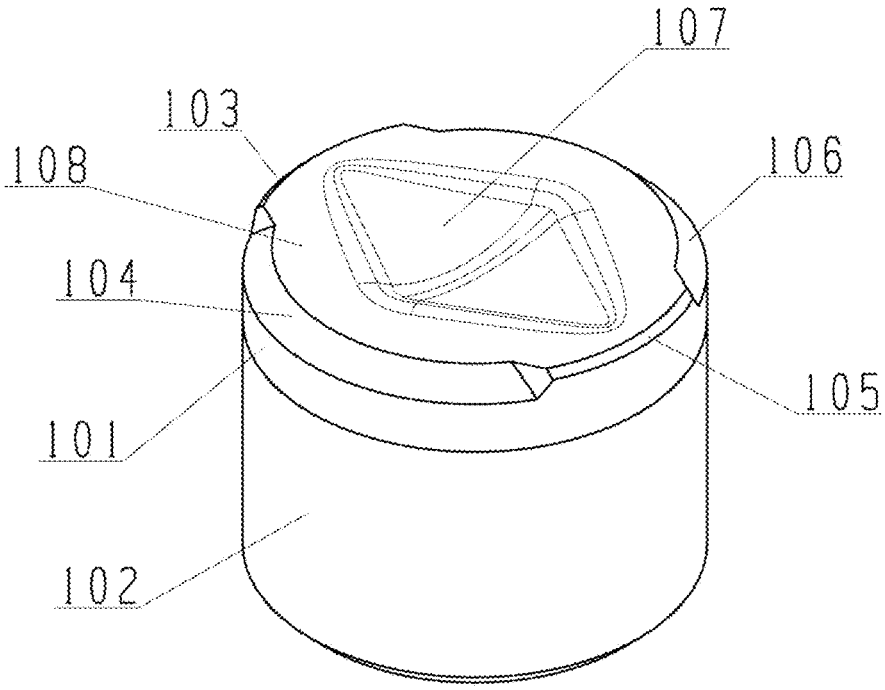
FIG. 1 to FIG. 3 are respectively a perspective view, a top view and an A-A rotary sectional view of Embodiment One of the present disclosure.
Figure 2:
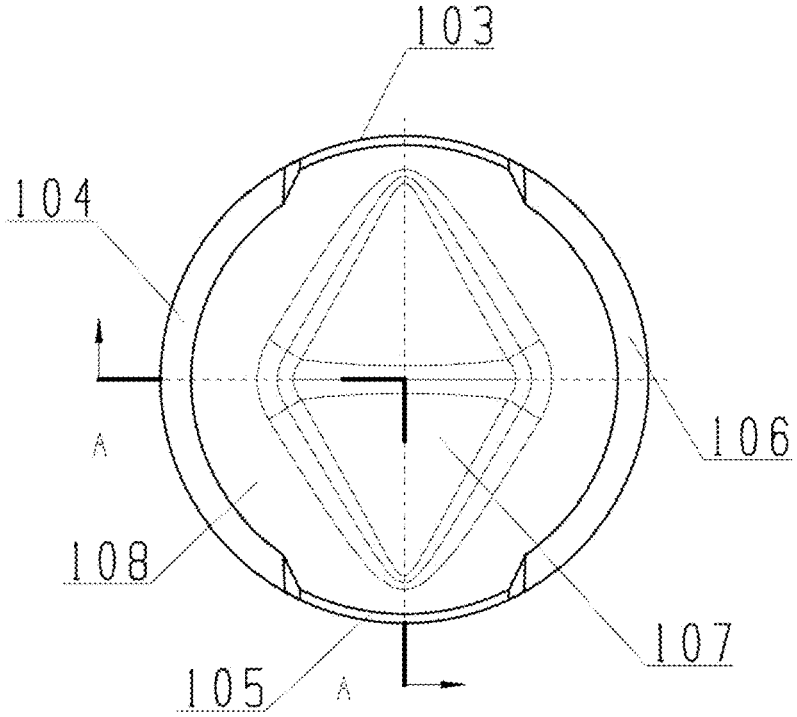
Figure 3:
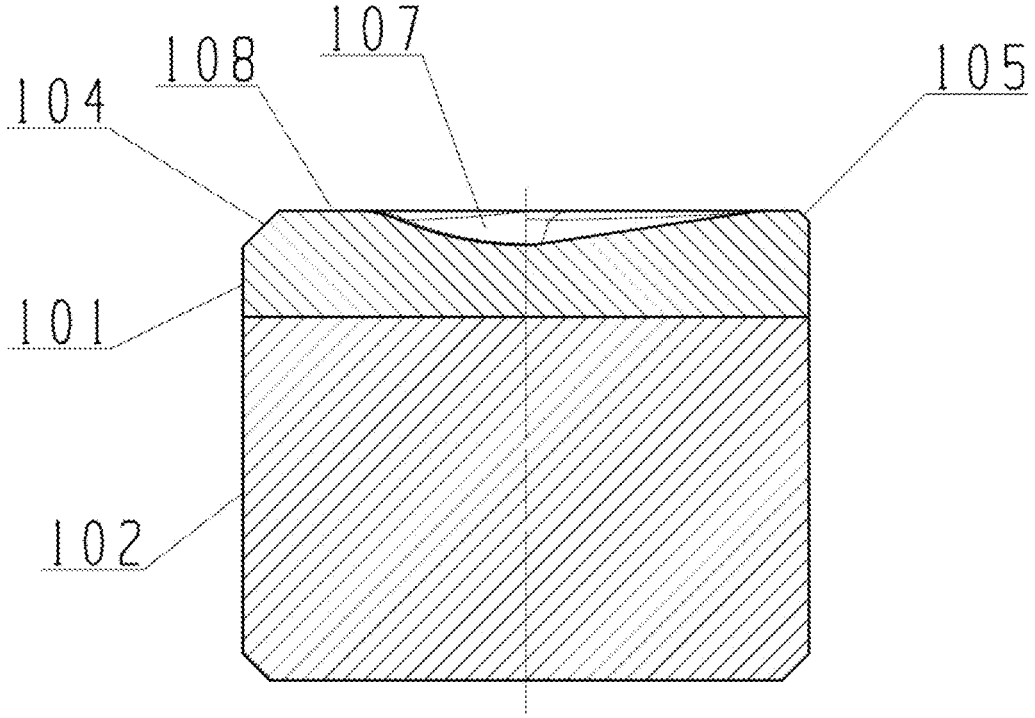

Embodiment one is shown in FIG. 1 to FIG. 3. An impact-resistant multi-cutting-edge diamond compact includes a cylindrical cemented carbide substrate 102 and a diamond composite layer 101, and the diamond composite layer is disposed at a top end of the cemented carbide substrate. The diamond composite layer is a polycrystalline diamond composite layer, and the diamond composite layer and the cemented carbide substrate are integrated through ultra-high-temperature and high-pressure sintering. A top end surface 108 of the diamond composite layer is a plane, and four sections of chamfers, i.e., 103, 104, 105 and 106, are provided at an edge of the end surface of the diamond composite layer. Two sections of chamfers, i.e., 103 and 105, are the same, i.e., single-beveled-surface chamfers of 45° with an axial height of 0.3 mm, a central angle corresponding to each section of chamfer being 60°, and form main cutting edges which bore deeply into a stratum when the stratum is drilled and have a stronger aggressiveness. The other two sections of chamfers, i.e., 104 and 106, are the same, i.e., single-beveled-surface chamfers of 45° with an axial height of 1 mm, a central angle corresponding to each section of chamfer being 120°, and form impact-resistant cutting edges. A flow guide cavity includes a flow guide groove which tapers from inside to outside along a radial direction of the diamond composite layer, and two flow guide grooves of the flow guide cavity lead to the two main cutting edges. In this embodiment, the chamfers are circumferentially provided and connected in sequence, and the chamfers transit smoothly. A radial cross section of the diamond compact is circular. By providing the flow guide cavity in the end face of the diamond composite layer, a water flow is guided to the main cutting edge to cool the main cutting edge when the compact drills the stratum. In addition, the flow guide cavity is recessed, so that the heat dissipation area is increased, which further increases the drilling rate and prolongs the service life of the compact.

Figure 4:
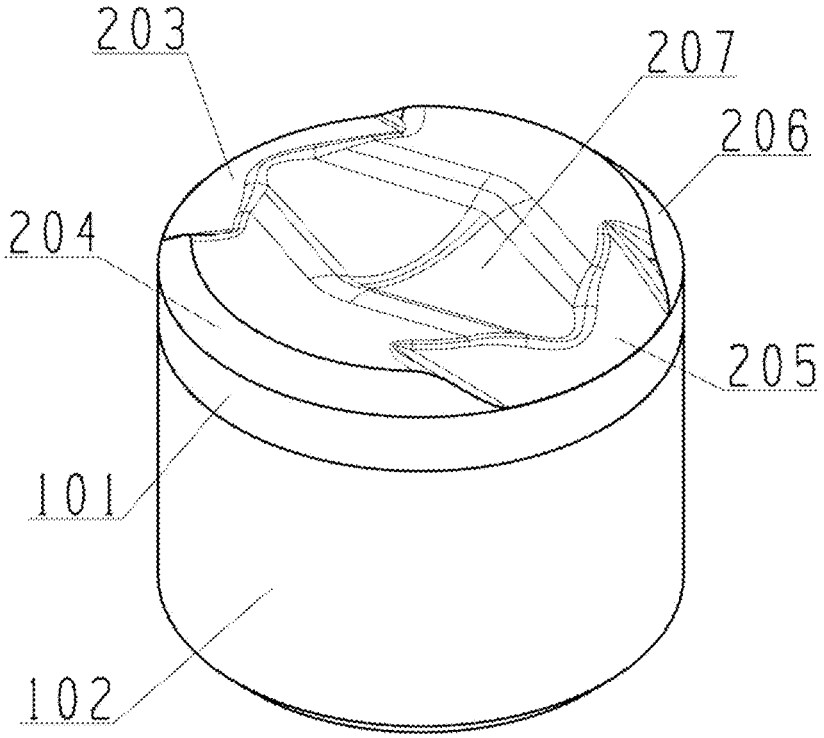
FIG. 4 to FIG. 6 are respectively a perspective view, a top view and an A-A rotary sectional view of Embodiment Two of the present disclosure.
Figure 5:
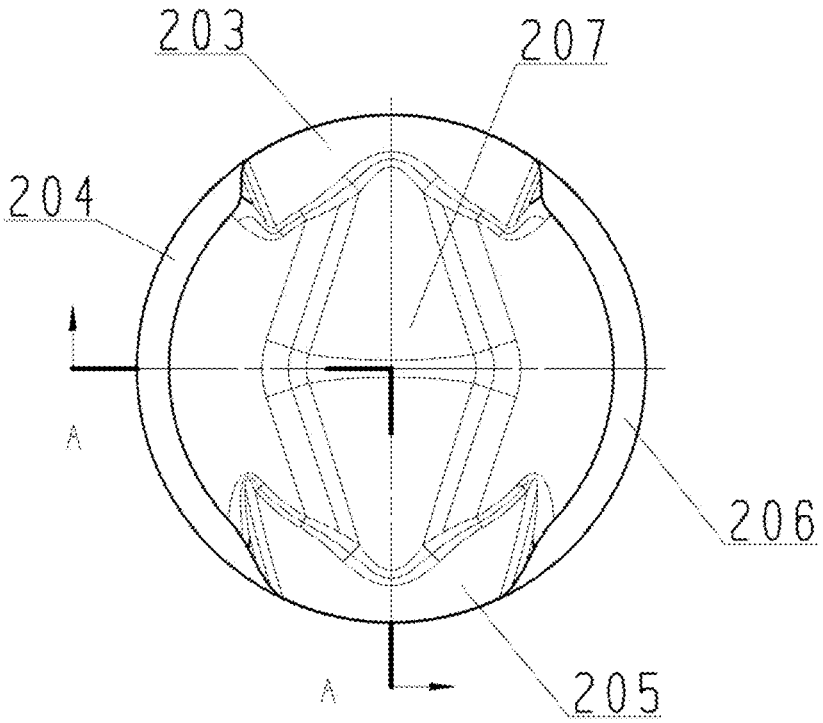
Figure 6:
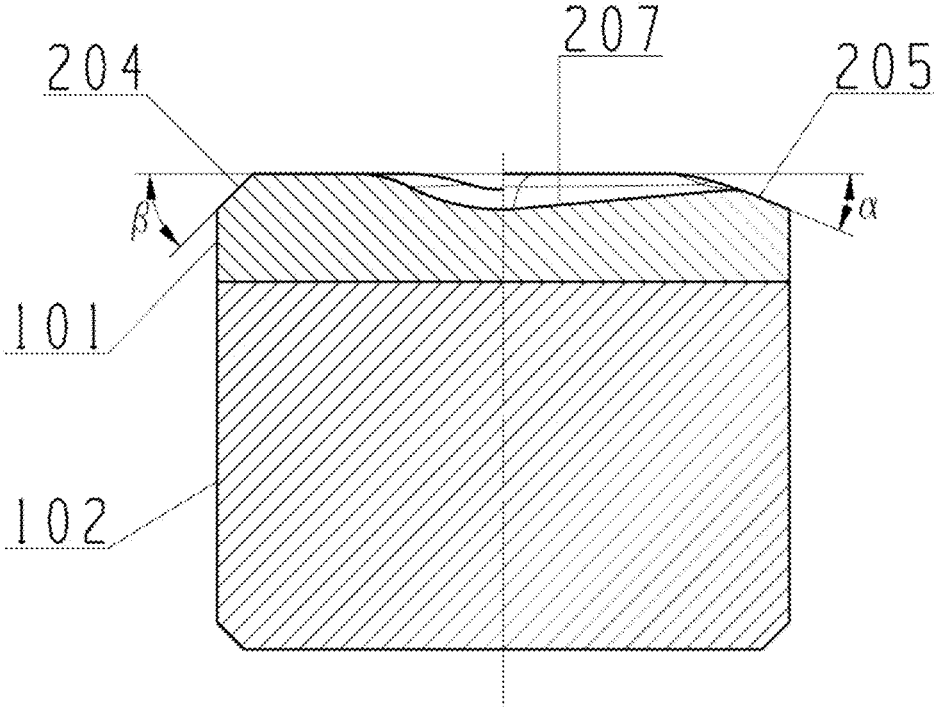

Embodiment Two is shown in FIG. 4 to FIG. 6, and differs from Embodiment One in the following aspect. Two sections of chamfers, i.e., 203 and 205, are the same, i.e., single-beveled-surface chamfers with an axial height of 0.8 mm and an included angle $\alpha$ of 22.5°, a central angle corresponding to each section of chamfer being 60°, and form main cutting edges. Two other sections of chamfers i.e., 204 and 206, are the same, i.e., single-beveled-surface chamfers with an axial height of 1 mm and an included angle $\beta$ of 45°, a central angle corresponding to each section of chamfer is 120°, and form impact-resistant cutting edges. Other structures including a structure of the flow guide cavity 207 are the same as those in Embodiment One.

Figure 7:
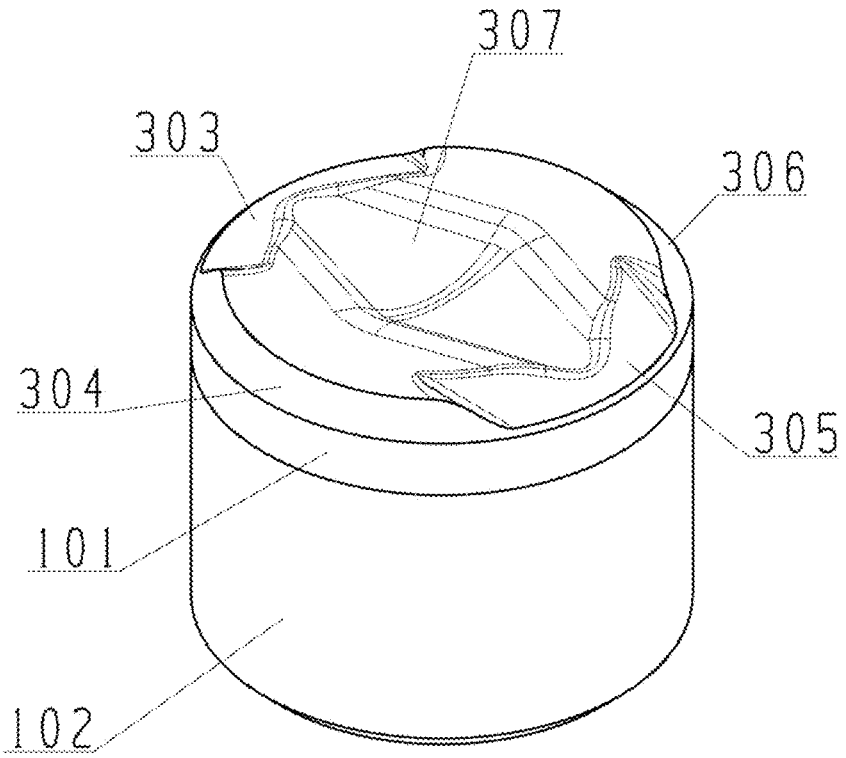
FIG. 7 to FIG. 9 are respectively a perspective view, a top view and an A-A rotary sectional view of Embodiment Three of the present disclosure.
Figure 8:
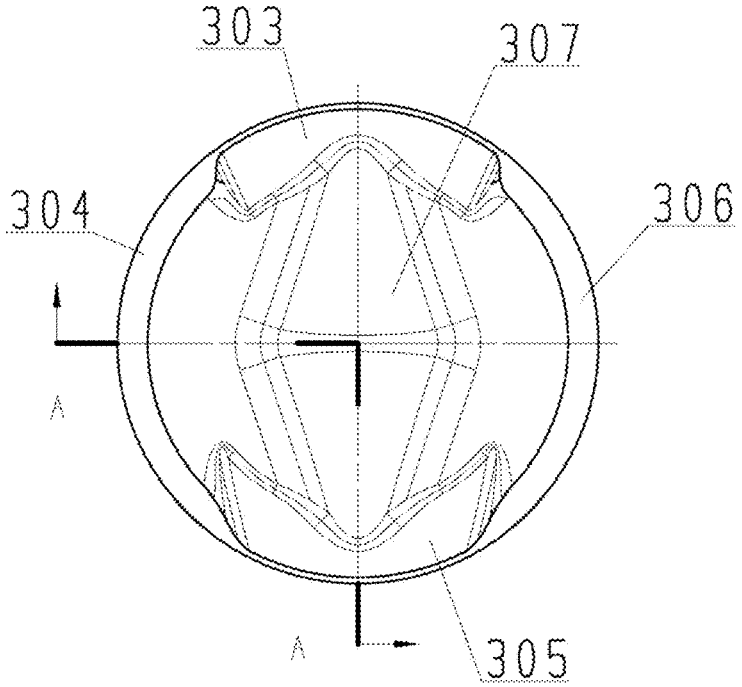
Figure 9:
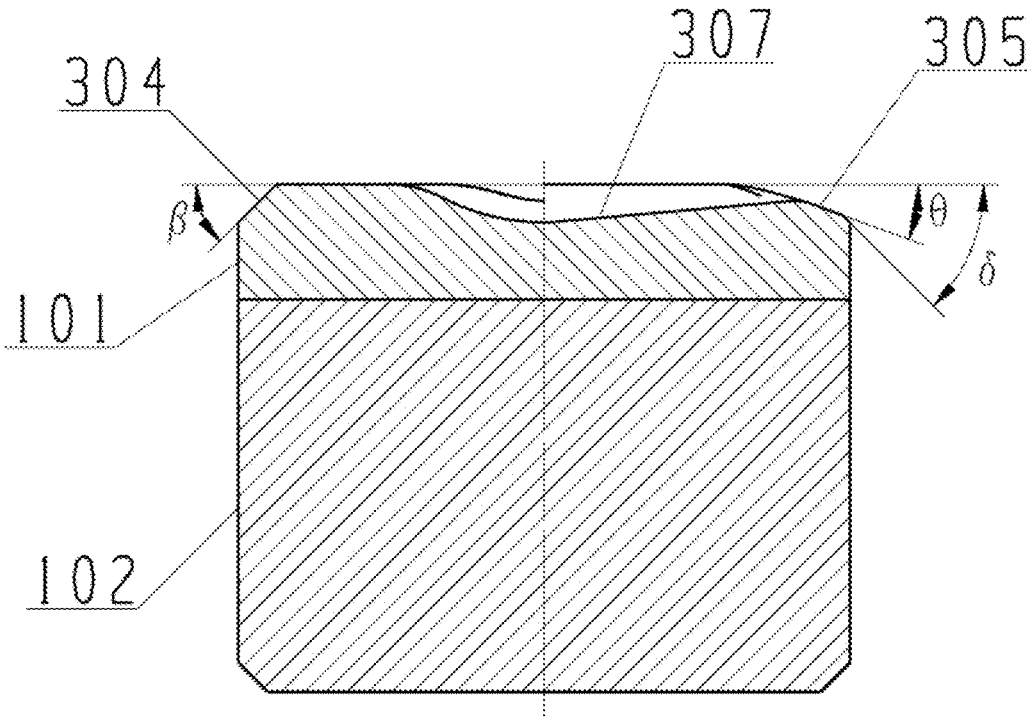

Embodiment Three is shown in FIG. 7 to FIG. 9, and differs from Embodiment Two in the following aspect. Two sections of chamfers, i.e., 303 and 305, are the same, i.e., double-beveled-surface chamfers, an inner beveled-surface chamfer having an axial height of 0.8 mm and an included angle $\theta$ of 20°, an outer beveled-surface chamfer having an axial height of 0.2 mm and an included angle $\delta$ of 45°, a central angle corresponding to each section of chamfer being 60°, and form main cutting edges. Other structures including structures of the other two sections of chamfers, i.e., 304 and 306, and a structure of a flow guide cavity 307 are the same as those in Embodiment Two.

Figure 10:
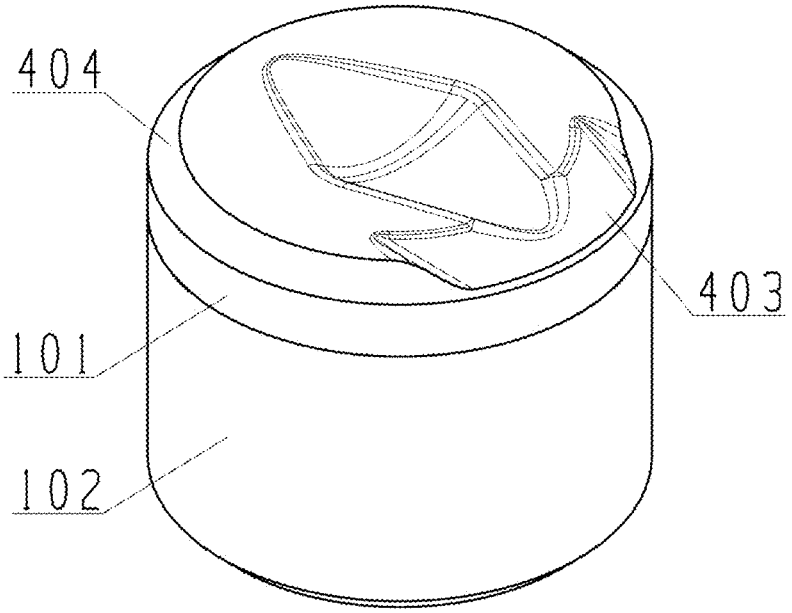
FIG. 10 is a perspective view of Embodiment Four of the present disclosure.

Embodiment Four is shown in FIG. 10, and differs from Embodiment Three in the following aspect. There is a double-beveled-surface chamfer 403 which only forms one section of main cutting edge. The double-beveled-surface chamfer 403 is a double-beveled-surface chamfer with an inner beveled-surface chamfer having an axial height of 0.8 mm and an included angle θ of 20° and an outer beveled-surface chamfer having an axial height of 0.2 mm and an included angle δ of 45°, a central angle corresponding to the chamfer being 60°, and form one main cutting edge. The remaining circumferential edges are all single-beveled-surface chamfers 404 with an axial height of 1 mm and an included angle of 45°, and form an impact-resistant cutting edge. Other structures are the same as those in Embodiment Three.

Figure 11:
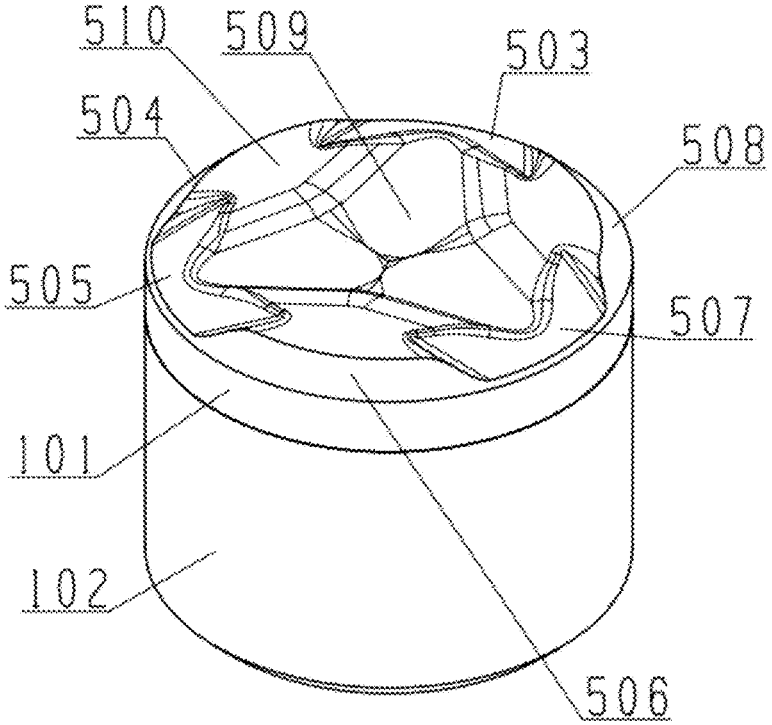
FIG. 11 is a perspective view of Embodiment Five of the present disclosure.

The Embodiment Five is shown in FIG. 11, which differs from Embodiment Three in the following aspect. Three sections of chamfers, i.e., 503, 505 and 507, are the same, are double-beveled-surface chamfers with an inner beveled-surface chamfer having an axial height of 0.8 mm and an included angle θ of 20° and an outer beveled-surface chamfer having an axial height of 0.2 mm and an included angle δ of 45°, a central angle corresponding to each section of chamfer being 60°, and form three sections of main cutting edges. Three single-beveled-surface chamfers, i.e., 504, 506 and 508, with the same structure are respectively provided between the three sections of double-beveled-surface chamfers, are single-beveled-surface chamfers with an axial height of 1 mm and an included angle of 45°, a central angle corresponding to each section of chamfer being 60°, and form impact-resistant cutting edges. Three flow guide grooves of the flow guide cavity respectively lead to three main cutting edges. Other structures are the same as those in Embodiment Three.

Figure 12:
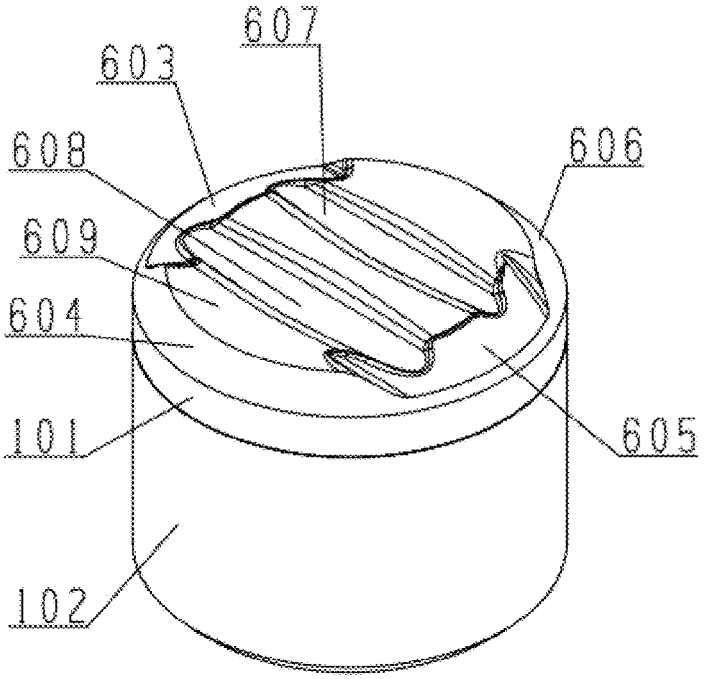
FIG. 12 is a perspective view of Embodiment Six of the present disclosure.

Embodiment Six is shown in FIG. 12, and differs from Embodiment Three in the following aspect. Two flow guide cavities, i.e., 607 and 608, provided at intervals (for example, provided in parallel) are provided on two sides of the middle of the end face of the diamond composite layer. The flow guide cavity includes a flow guide groove which tapers from inside to outside, and the flow guide groove of the flow guide cavity leads to the main cutting edge. Other structures including structures of two double-beveled-surface chamfers i.e., 603 and 605, and structures of two single-beveled-surface chamfers, i.e., 604 and 606, are the same as those in Embodiment Three.

In some embodiments of the present disclosure, the multiple sections of chamfers in the circumferential direction of the top edge may be different, and multiple chamfers in the above embodiments may be different or partially different. Two different sections of chamfers meet one of the following conditions: types are different; and the types are the same, but structural parameters are different.

The present disclosure also provides an earth-boring tool, such as a drill bit for drilling a petroleum well, which includes the impact-resistant multi-cutting-edge diamond compact described above.

Finally, it should be noted that the above embodiments are only used to describe technical solutions of the present disclosure rather than limit the same; although the present disclosure is described in detail with reference to preferred embodiments, it should be understood by those of ordinary skills in the art that specific embodiments of the present disclosure may still be modified or some technical features may be equivalently replaced, all of which should be covered within the scope of the technical solutions claimed by the present disclosure.

The invention claimed is:

1. An impact-resistant multi-cutting-edge diamond compact, comprising a cylindrical cemented carbide substrate (102) and a diamond composite layer (101), the diamond composite layer being disposed at a top end of the cemented carbide substrate, wherein at least two sections of different chamfers (103, 104) are provided on a circumferential edge of a top end of the diamond composite layer (101), so as to form different cutting edges, the different cutting edges comprise at least one section of main cutting edge (103) and a section of impact-resistant cutting edge (104; 106) is provided on each of two sides of the main cutting edge (103), a cutting performance of the main cutting edge (103) is better than that of the impact-resistant cutting edge (104; 106);

a recessed flow guide cavity (107) is provided on a top end face of the diamond composite layer (101) to guide a water flow to the main cutting edge (103) when a stratum is drilled so as to cool the main cutting edge (103), wherein the recessed flow guide cavity (107) comprises a flow guide groove that tapers from inside to outside along a radial direction of the diamond composite layer, and an outer end of the flow guide groove is adjacent to the main cutting edge (103) or intersects with the main cutting edge (103).

2. The impact-resistant multi-cutting-edge diamond compact according to claim 1, wherein the entire circumferential edge of the top end of the diamond composite layer (101) is provided with 2 to 4 sections of different chamfers, thereby forming 2 to 4 sections of different cutting edges.

3. The impact-resistant multi-cutting-edge diamond compact according to claim 2, wherein the chamfer comprises at least the following types: a single-beveled-surface chamfer, a double-beveled-surface chamfer, or a curved-surface chamfer.

4. The impact-resistant multi-cutting-edge diamond compact according to claim 2, wherein two different sections of chamfers meet one of the following conditions:

types are different; and the types are the same, but structural parameters are different.

5. The impact-resistant multi-cutting-edge diamond compact according to claim 2, wherein an included angle between a beveled surface of the chamfer and a radial plane of the diamond composite layer (101) ranges from 20° to 70°, and the top end of the diamond composite layer (101) is perpendicular to an axis of the cylindrical cemented carbide substrate (102).

6. The impact-resistant multi-cutting-edge diamond compact according to claim 2, wherein an axial height of the chamfer ranges from 0.2 to 3 mm, or a radial width of the chamfer ranges from 0.2 to 5 mm.

7. The impact-resistant multi-cutting-edge diamond compact according to claim 3, wherein the main cutting edge is a single-beveled-surface chamfer with a radial width of less than 0.4 mm and an included angle of 45°, or a single-beveled-surface chamfer with a radial width of greater than 0.4 mm and an included angle of less than 30°, or a double-beveled-surface chamfer with a radial width of greater than 0.4 mm and an inclination angle of less than 30° of an inner beveled-surface, and a central angle corresponding to each main cutting edge ranges from 50° to 70°.

8. The impact-resistant multi-cutting-edge diamond compact according to claim 3, wherein the double-beveled-surface chamfer comprises an inner beveled-surface and an outer beveled-surface, and an included angle between the outer beveled-surface and a radial plane of the diamond composite layer (101) is greater than an included angle between the inner beveled-surface and the radial plane of the diamond composite layer (101).

9. The impact-resistant multi-cutting-edge diamond compact according to claim 3, wherein the impact-resistant cutting edge is a single-beveled-surface chamfer with a radial width ranging from 0.5 to 2 mm and an included angle of greater than or equal to 45° or a circular arc chamfer with a radius of curvature ranging from 0.5 to 2 mm.

10. An earth-boring tool, comprising the impact-resistant multi-cutting-edge diamond compact according to claim 1.

11. The impact-resistant multi-cutting-edge diamond compact according to claim 1, comprising two recessed flow guide cavities (107) provided at intervals.

12. The impact-resistant multi-cutting-edge diamond compact according to claim 1, comprising multiple sections of main cutting edges (503, 505, 507) and multiple sections of impact-resistant cutting edges (504, 506, 508), wherein the main cutting edges and the impact-resistant cutting edges are alternately provided, and a plurality of flow guide grooves (509) are respectively and correspondingly provided between the multiple sections of main cutting edges (503, 505, 507) and a center of the top end face of the diamond composite layer (101), inner ends of the plurality of flow guide grooves (509) converging at the center of the top end face of the diamond composite layer (101).

13. The impact-resistant multi-cutting-edge diamond compact according to claim 1, comprising two main cutting edges (603, 605) provided at intervals, wherein the two recessed flow guide cavities (107) provided at intervals extend between the two main cutting edges (603, 605) provided at intervals.

* * * * *